US006418845B1

(12) United States Patent
Satoh et al.

(10) Patent No.: US 6,418,845 B1
(45) Date of Patent: Jul. 16, 2002

(54) PRINTING CYLINDER FOR OFFSET PRINTING

(75) Inventors: Masayoshi Satoh, Yokohama; Shinji Kawashima, Kawasaki, both of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/613,286

(22) Filed: Jul. 10, 2000

(30) Foreign Application Priority Data

Dec. 15, 1999 (JP) ..... 11-356271

(51) Int. Cl.[7] ..... B41F 5/00
(52) U.S. Cl. ..... 101/216; 101/375; 492/47
(58) Field of Search ..... 101/212, 216, 101/141, 368, 375, 248; 492/21, 27, 31, 36, 40, 45, 47

(56) References Cited

U.S. PATENT DOCUMENTS

| | | | | |
|---|---|---|---|---|
| 4,220,083 A | * | 9/1980 | Fischer | 101/216 |
| 5,249,522 A | * | 10/1993 | Kusch et al. | 101/248 |
| 5,570,634 A | * | 11/1996 | Harter | 101/375 |
| 5,960,714 A | * | 10/1999 | Gottling et al. | 101/216 |
| 6,186,065 B1 | * | 2/2001 | Kersch et al. | 101/216 |

FOREIGN PATENT DOCUMENTS

| | | | |
|---|---|---|---|
| JP | 1-242250 | * | 9/1989 |
| JP | 7-256864 | * | 10/1995 |
| JP | 2825784 | * | 9/1998 |

* cited by examiner

*Primary Examiner*—Ren Yan
(74) *Attorney, Agent, or Firm*—Armstrong, Westerman & Hattori, LLP

(57) ABSTRACT

A printing cylinder for offset printing includes a cylinder member of a hollow cylinder having a covering portion which forms a substantially uniform, smooth outer circumferential surface having no spliced portion in the circumferential direction, the covering portion being capable of transferring printing images onto an adjacent printing cylinder or printing paper in contact with the covering portion; and printing cylinder support mechanism including a pair of support shafts which are supported on opposed frames such that the support shafts are rotatable about a common axis, the support shafts each having a shaft end portion which is connected to an end portion of the cylinder member via an engagement portion and by use of connection member. The engagement portion includes a depression and a projection formed on the end surface of the cylinder member and the shaft end portion of the corresponding support shaft. Upon engagement of the depression and the projection of each engagement portion, the cylinder member and the support shafts are connected in an aligned manner.

6 Claims, 3 Drawing Sheets

PRINTING CYLINDER FOR OFFSET PRINTING

BACKGROUND OF THE INVENTION

1. Field of the Invention

The present invention relates to a printing cylinder for offset printing which is removably attached onto a printing machine.

2. Description of the Related Art

Japanese Patent No. 2825784 and Japanese Patent Application Laid-Open (kokai) No. 7-256864 disclose examples of a conventional printing cylinder for offset printing which is removably attached onto a printing machine. Further, Japanese Patent Application Laid-Open (kokai) No. 1-242250 discloses a conventional printing cylinder for gravure printing which is removably attached onto a printing machine.

The printing cylinder disclosed in Japanese Patent No. 2825784 consists of a cylinder body, an endless rubber blanket attached to the outer circumferential surface of the cylinder body, and bearing journals connected to the opposite ends of the cylinder body. The bearing journals are attached to opposed frames such that the flanges of the bearing journals face each other while sharing a common center axis. Each of the flanges of the bearing journals can be moved toward the corresponding frame, so that the distance between the flanges becomes slightly greater than the axial length of the printing cylinder.

The printing cylinder has a centering/release apparatus provided with the cylinder body. Specifically, stopper disks are disposed within and fixed to a through hole which extends in the axial direction of the cylinder body. A pin having a tip end of a truncated conical shape is disposed between each of the stopper disks and the inner surface of the flange of the corresponding bearing journal such that the pin is movable in the axial direction only. On the inner surface of the flange of each bearing journal is formed a tapered circular depression for receiving the tip end of the corresponding pin.

An adjustment bolt is inserted into each stopper disk such that the head portion of the adjustment bolt is in contact with the stopper disk, whereby axial movement of the adjustment bolt toward the corresponding pin is restricted. The tip end of the adjustment bolt is screwed into a through hole of the pin, and a compression spring is disposed between the stopper disk and the inner end surface of the pin. Further, a manipulation hole is formed in each bearing journal such that the manipulation hole is aligned with the through hole of the pin.

A tool inserted into the manipulation hole of the bearing journal and further into the through hole of the pin is engaged with a depression formed on the tip end surface of the adjustment bolt. Subsequently, the tool is rotated in order to rotate the adjustment bolt to thereby advance or retract the pin in the axial direction. Through this axial movement of the pin, the engagement between the truncated-conical tip end of the pin and the tapered depression in the inner surface of the bearing journal is established or broken.

The adjustment bolt may be rotated by use a motor which is disposed within the printing cylinder and has a motor shaft connected to the adjustment bolt.

The printing cylinder is attached onto the printing machine as follows. First, in a state in which the pins are retracted into the cylinder body, the cylinder body is placed between the opposed flanges of the bearing journals, and the pins are projected from the cylinder body and fitted into the tapered depressions of the flanges. Subsequently, the flanges are fixed to the opposed end surfaces of the cylinder body by use of bolts.

The patent publication discloses another mechanism for advancing and retracting pins. Only a compression spring is disposed within the through hole of the cylinder body in order to bias the pins such that their tip ends project from the opposite end surfaces of the cylinder body. A pressure chamber is formed between each pin and the cylinder body. When a pressurized medium is supplied to the pressure chamber, the pressure chamber expands axially, so that the pin is retracted into the cylinder body against the restoration force of the spring.

The printing cylinder disclosed in Japanese Patent Application Laid-Open No. 7-256864 can be used as a plate cylinder and a blanket cylinder. The printing cylinder consists of a cylindrical cylinder body, a shaft attached to one end of the cylinder body such that the center axis of the shaft is aligned with that of the cylinder body, and a tapered circular depression formed on the opposite end of the cylinder body such that the center axis of the depression is aligned with that of the cylinder body. Further, a groove is formed on the outer circumferential surface of the cylinder body such that the groove extends parallel to the center axis of the cylinder body to reach the opposite end surfaces. The groove can accommodate opposite end portions of a form plate or blanket. Alternatively, the groove can accommodate therein a winding shaft for winding the opposite end portions.

The printing cylinder is attached onto a printing machine by use of printing cylinder support means provided on the printing machine.

The printing cylinder support means includes opposed first and second frames, the first frame having an opening through which a printing cylinder is loaded; a sub-frame disposed on the outer side of the opening of the first frame to be movable along the side surface of the first frame and adapted to support a shaft provided at a first end of the printing cylinder; and a support shaft which is supported on the second frame such that the center axis of the support shaft is aligned with the printing cylinder support position of the sub-frame and which is adapted to be fitted into a tapered circular depression provided at the second end of the printing cylinder to thereby support the second end of the printing cylinder.

The printing cylinder is attached onto the printing machine as follows. The printing cylinder is loaded via the opening of the first frame and is positioned such that the truncated conical tip end of the support shaft provided on the second frame is fitted into the tapered circular depression provided at the second end of the printing cylinder. Subsequently, the sub-frame disposed on the outer side of the first frame having the opening is moved so as to close the frame opening. As a result, the sub-frame comes into contact with the shaft at the first end of the printing cylinder to thereby support the shaft.

The printing cylinder disclosed in Japanese Patent Application Laid-Open No. 1-242250 is used as a plate cylinder. The printing cylinder has a cylindrical shape, and a tapered circular depression is formed on each of the opposite ends of the printing cylinder such that the center axes of the tapered circular depressions are aligned with each other. Further, a key groove is formed in one of the tapered circular depressions.

The printing cylinder is supported by printing cylinder support means provided on the printing machine.

The printing cylinder support means consists of two support shafts which are supported on opposed drive-side and manipulation-side frames such that the support shafts are rotatable about a common center axis and are axially movable; two moving mechanisms for moving the respective support shafts in the axial direction; a drive transmission mechanism disposed on the drive-side frame and adapted to transmit rotation to the drive-side support shaft; and a constant phase stop mechanism for stopping the drive-side support shaft at a preset angular position in the circumferential direction.

Each of the two support shafts for supporting the printing cylinder has a truncated conical tip end, which is fitted into a tapered circular depression formed on the corresponding end surface of the printing cylinder. Further, at the tip end of the drive-side support shaft is attached a key which is to be fitted into the key groove provided in the corresponding tapered circular depression of the printing cylinder.

The moving mechanism for moving the drive-side support shaft includes a bearing sleeve which is disposed on the drive-side frame to be movable in the axial direction and which rotatably supports the drive-side support shaft; and a hydraulic cylinder for axially moving the drive-side support shaft.

The rod of the hydraulic cylinder attached to the outer side of the drive-side frame is connected to the rear end of the drive-side support shaft. Therefore, the drive-side support shaft is moved in the axial direction in accordance with advancing and retracting motion of the piston of the hydraulic cylinder.

The moving mechanism for moving the manipulation-side support shaft includes a sleeve which surrounds the shaft portion of the manipulation-side support shaft in order to support the support shaft while allowing its rotation but restricting its axial movement. This sleeve is supported by bearings provided on the manipulation-side frame such that its axial movement is permitted, but its rotation is restricted.

A rack is provided on the outer circumferential surface of the sleeve in parallel to the center axis thereof. A pinion in meshing engagement with the rack is connected to an electric motor of a drive source. The motor operates in accordance with a detection signal output from a potentiometer which detects the axial position of the sleeve, and stops the manipulation-side support shaft at a predetermined axial stop position.

The drive transmission mechanism comprises a gear which is rotatably disposed on the outer side of the drive-side frame and is driven by an electric motor of a main drive source. The shaft portion of the drive-side support shaft penetrates the gear and is connected thereto via a sliding key.

The constant phase stop mechanism comprises an encoder provided on a main spindle driven by the electric motor of the main drive source and adapted to detect the angular position or phase of the drive-side support shaft; a stop motor connected to the main spindle via a gear; and a controller for driving the stop motor at very low speed to thereby stop the drive-side support shaft at the predetermined angular position.

The printing cylinder is attached onto the printing machine as follows. After being loaded in the printing machine from an opening formed in the drive-side frame, the printing cylinder is positioned at the predetermined angular position at which the key provided on the drive-side support shaft in a waiting state can be fitted into the key groove formed on the tapered circular depression formed on the corresponding end surface of the printing cylinder. Subsequently, a lifter provided within the printing machine is operated in order to move the printing cylinder to an attachment position.

Subsequently, upon drive of the motor connected to the manipulation-side support shaft, the manipulation-side support shaft advances and stops at a predetermined support position, after which the drive-side support shaft advances due to extension of the rod of the hydraulic cylinder connected to the drive-side support shaft. As a result, the tip end of the drive-side support shaft is fitted into one of the tapered circular depressions of the printing cylinder, whereby the drive-side support shaft is connected to the printing cylinder via the key with a predetermined phase relationship. Further, the other tapered circular depression of the printing cylinder is pressed against the tip end of the manipulation-side support shaft to be fitted therein. Thus, the printing cylinder is supported.

The above-described conventional techniques have the following drawbacks.

In the printing cylinder disclosed in Japanese Patent No. 2825784, since pins to be connected to the printing cylinder support means are provided within the printing cylinder, the radius and weight of the printing cylinder increase, and the printing cylinder deforms to a large extent due to its weight.

Therefore, the printing cylinder is likely to generate vibration upon rotation in the course of printing operation, so that the printing cylinder cannot be rotated stably at high speed.

Further, since the weight is large, handling of the printing cylinder is cumbersome, and a large burden is imposed on a worker. Further, the complicated structure of the centering/release apparatus provided in the printing cylinder increases cost and time needed for maintenance.

In the printing cylinder disclosed in Japanese Application Laid-Open No. 7-256864, a groove for receiving a form plate or blanket is formed on the circumferential surface. In the printing cylinder, every time the opening portion of the groove faces the circumferential surface of another printing cylinder in contact with the above printing cylinder during printing operation, the contact pressure produced between the two printing cylinders drops, resulting in generation of vibration on both printing cylinders.

Due to these vibrations, printing pressure acting on a paper web undergoing printing varies, resulting in deteriorated quality of printed materials. Further, during each revolution of the printing cylinder, a portion of the blanket or form plate located at the edge of the opening portion is struck by the circumferential surface of the opposed printing cylinder, with the result that that portion wears and is easily cut. Accordingly, the service life of the blanket or form plate becomes comparatively short.

Further, in the case in which a winding shaft into which a form plate or blanket is inserted for attachment is provided within the printing cylinder, the wall thickness of the printing cylinder must be increased. As a result, the weight of the printing cylinder increases, and thus the amount of deformation of the printing cylinder becomes relatively large. Therefore, the printing cylinder is likely to generate vibration upon rotation, with the result that the printing operation cannot be performed at high speed.

Moreover, one of the frames for supporting the printing cylinder must have a large opening for enabling loading and unloading of the printing cylinder, as well as a sub-frame for covering the opening. Further, a space must be provided on the outer side of the opening in order to enable loading and unloading of the printing cylinder for replacement.

The printing cylinder for gravure printing disclosed in Japanese Patent Application Laid-Open No. 1-242250 is designed such that printing images are engraved directly on the outer circumferential surface of the main cylinder portion. Therefore, when the outer circumferential surface of the main cylinder portion is damaged, the printing cylinder must be discarded. Further, when the printing cylinder is attached, first the manipulation-side support shaft moves axially and stops at a predetermined stop position for waiting, and subsequently, the drive-side support shaft moves axially, so that the drive-side support shaft is connected to the printing cylinder via the key to thereby support the printing cylinder. Therefore, the position of the printing cylinder in the axial direction is determined by the predetermined stop position of the manipulation-side support shaft, and the position of the printing cylinder in the circumferential position is determined by the key connection position of the drive-side support shaft. Therefore, the operation of attaching the printing cylinder is very complex.

Since the moving mechanism for axially moving the support shaft of the printing cylinder support means is provided on the outer side of each frame such that the moving mechanism projects outward by a considerable distance, installation space is difficult to reduce, the complicated mechanism increases cost, and maintenance is time consuming.

Moreover, the printing cylinder is difficult to apply to an offset rotary press in which a plurality of plating cylinders and a large number of inking rollers are disposed in parallel, unlike the case of a gravure rotary press.

SUMMARY OF THE INVENTION

An object of the present invention is to solve all the problems involved in the above-described conventional techniques and to provide an improved printing cylinder for offset printing, in which a plurality of printing cylinders are disposed adjacent to each other.

In order to achieve the above object, the present invention provides a printing cylinder for offset printing comprising: a cylinder member of a hollow cylinder having a covering portion which forms a substantially uniform, smooth outer circumferential surface having no spliced portion in the circumferential direction, the covering portion being capable of transferring printing images onto an adjacent printing cylinder or printing paper in contact with the covering portion; and printing cylinder support means including a pair of support shafts which are supported on opposed frames such that the support shafts are rotatable about a common axis, the support shafts each having a shaft end portion which is connected to an end portion of the cylinder member via an engagement portion and by use of connection means.

Preferably, each engagement portion includes a tapered circular depression formed at the center of an end surface of the cylinder member and having a diameter which increases toward the open end of the depression, and a truncated conical projection formed at the center of the shaft end portion of the support shaft located at the inner side of the corresponding frame, wherein the truncated conical projection has a shape corresponding to that of the tapered circular depression.

Alternatively, the engagement portion includes a ridge portion formed on an end surface of the cylinder member such that the ridge portion extends in a radial direction from the circumferential edge to reach the center of the end surface, and a groove formed on the shaft end portion of the support shaft located at the inner side of the corresponding frame, the groove extending in a radial direction from the circumferential edge to reach the center of the shaft end portion, wherein the ridge portion has a shape corresponding to that of the groove.

Alternatively, the engagement portion includes a groove formed on an end surface of the cylinder member such that the groove extends in a radial direction from the circumferential edge to reach the center of the end surface, and a ridge portion formed on the shaft end portion of the support shaft located at the inner side of the corresponding frame, the ridge portion extending in a radial direction from the circumferential edge to reach the center of the shaft end portion, wherein the ridge portion has a shape corresponding to that of the groove.

Preferably, the connection means includes a plurality of threaded members disposed to extend between a bearer provided at either end of the cylinder member and a flange provided at the shaft end portion of the corresponding support shaft such that the threaded members are located at a plurality of positions which are not symmetrical with respect to the centers of the bearer and the flange.

Preferably, each of the support shafts is disposed to penetrate the corresponding frame and is supported on the frame via an eccentric sleeve and a bearing, the eccentric sleeve being supported on the frame such that rotation of the eccentric sleeve is permitted but axial movement of the eccentric sleeve is restricted, and the bearing being accommodated within an eccentric through hole of the eccentric sleeve such that the bearing is movable in the axial direction.

The printing cylinder for offset printing according to the present invention achieves the following effects.

(1) Since a groove for attachment of a form plate or blanket is not provided on the outer circumferential surface of the printing cylinder, noise and vibration during operation of the printing machine can be reduced, contributing to improvement in the environment of printing work, as well as improvement of printing quality.

(2) Since the main portion of the printing cylinder can be formed of a hollow cylinder, the wall thickness of the cylinder can be minimized within the range in which the printing cylinder can endure contact pressure (printing pressure) received from an adjacent cylinder, whereby the weight of the printing cylinder for offset printing can be reduced greatly and its mechanism can be simplified with a resultant reduction in cost. In addition, since the amount of deformation of the printing cylinder decreases, the printing cylinder can be rotated stably at high speed, so that printing quality and the performance of the printing machine are improved. Moreover, since the printing cylinder is lightweight, handling of the printing cylinder and the work for attaching the printing cylinder onto the printing machine are easy, so that the burden imposed on a worker is reduced and work efficiency is improved.

(3) Since the printing cylinder can be fixed at a predetermined angular position during the operation of attaching the printing cylinder onto the printing machine, upon startup of the printing machine a registration operation can be performed quickly and accurately by use of an adjustment apparatus which can adjust at least a multicolor printing register or a double-sided printing register, enabling the printing machine to produce printed materials of high printing quality.

(4) When the outer circumference of the printing cylinder is damaged, or when printing images are changed, only the covering portion—which forms the outer circumferential surface of the printing cylinder—is regenerated to thereby enable repeated use of the printing cylinder. Therefore, wasteful consumption of resources due to disposal of the printing cylinder as waste can be avoided.

(5) Since the support shafts are moved axially not at all or only slightly for attachment or detachment of the printing cylinder onto or from the printing machine, neither a special mechanism for attachment or detachment of the printing cylinder nor an extra space for allowing axial movement of the printing cylinder is required, thus contributing to space saving.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF PREFERRED EMBODIMENTS

Figure 1:
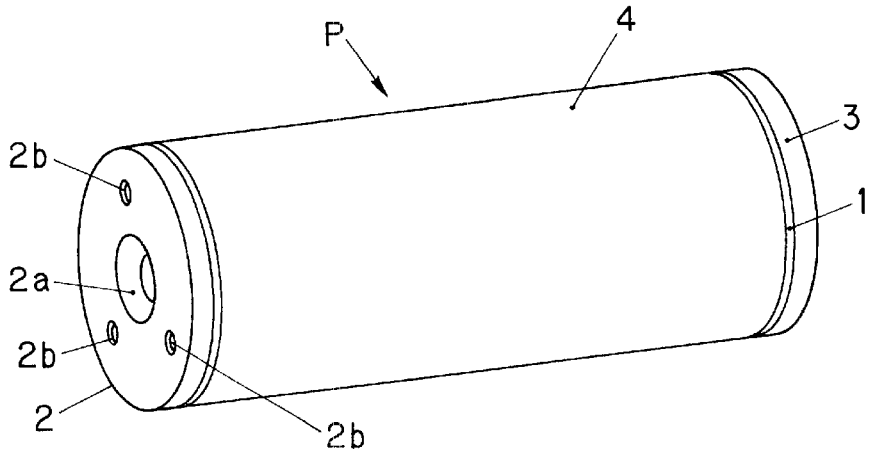
FIG. 1 is a perspective view of a printing cylinder for offset printing according to a first embodiment of the present invention.

Embodiments of the present invention will next be described in detail with reference to the drawings, while a printing cylinder for offset printing is taken as an example of a printing cylinder for a printing machine.

The printing cylinder for a printing machine comprises a cylinder member P and printing cylinder support means Q.

As shown in FIGS. 1, 2, 3 and 4, the cylinder member P includes a main cylinder portion 1 which assumes the form of a hollow cylinder; and disk-shaped bearers 2 and 3 attached to the opposite ends of the main cylinder portion 1.

A covering portion 4 is formed on the outer circumferential surface of the main cylinder portion 1 of the cylinder member P in order to form a substantially uniform, smooth outer circumferential surface without formation of a spliced portion in the circumferential direction. The covering portion 4 has a function of transferring printing images onto another plating cylinder or printing paper in contact with the covering portion 4.

The covering portion 4 is an image-forming layer on which lipophilic and hydrophilic regions are mixedly formed through irradiation of light, or an image transfer relay layer having a surface formed of, for example, a synthetic resin and capable of transferring and relaying printing images. A printing cylinder used as a plate cylinder for offset printing has the former layer; i.e., an image-forming layer, as the covering portion 4. A printing cylinder used as a blanket cylinder for offset printing has the latter layer; i.e., an image transfer relay layer, as the covering portion 4.

The covering portion 4 can be removed through dissolution, grinding, or detachment, and can be regenerated through application, bonding, or attachment.

The printing cylinder support means Q includes opposed frames 5 and 6; eccentric sleeves 15 and 16 provided on the frames 5 and 6, respectively, such that rotation is permitted but axial movement is restricted; bearings 9 and 10 respectively disposed within eccentric holes 17 and 18 penetrating the eccentric sleeves 15 and 16 such that the bearings 9 and 10 can move in the axial direction; and support shafts 7 and 8 penetrating the frames 5 and 6, respectively, and supported by the bearings 9 and 10, respectively. The support shafts 7 and 8 are connected to the bearers 2 and 3, respectively, of the cylinder member P.

Next, the structure of connection between the support shafts 7 and 8 and the bearers 2 and 3 of the cylinder member P will be described.

Figure 2:
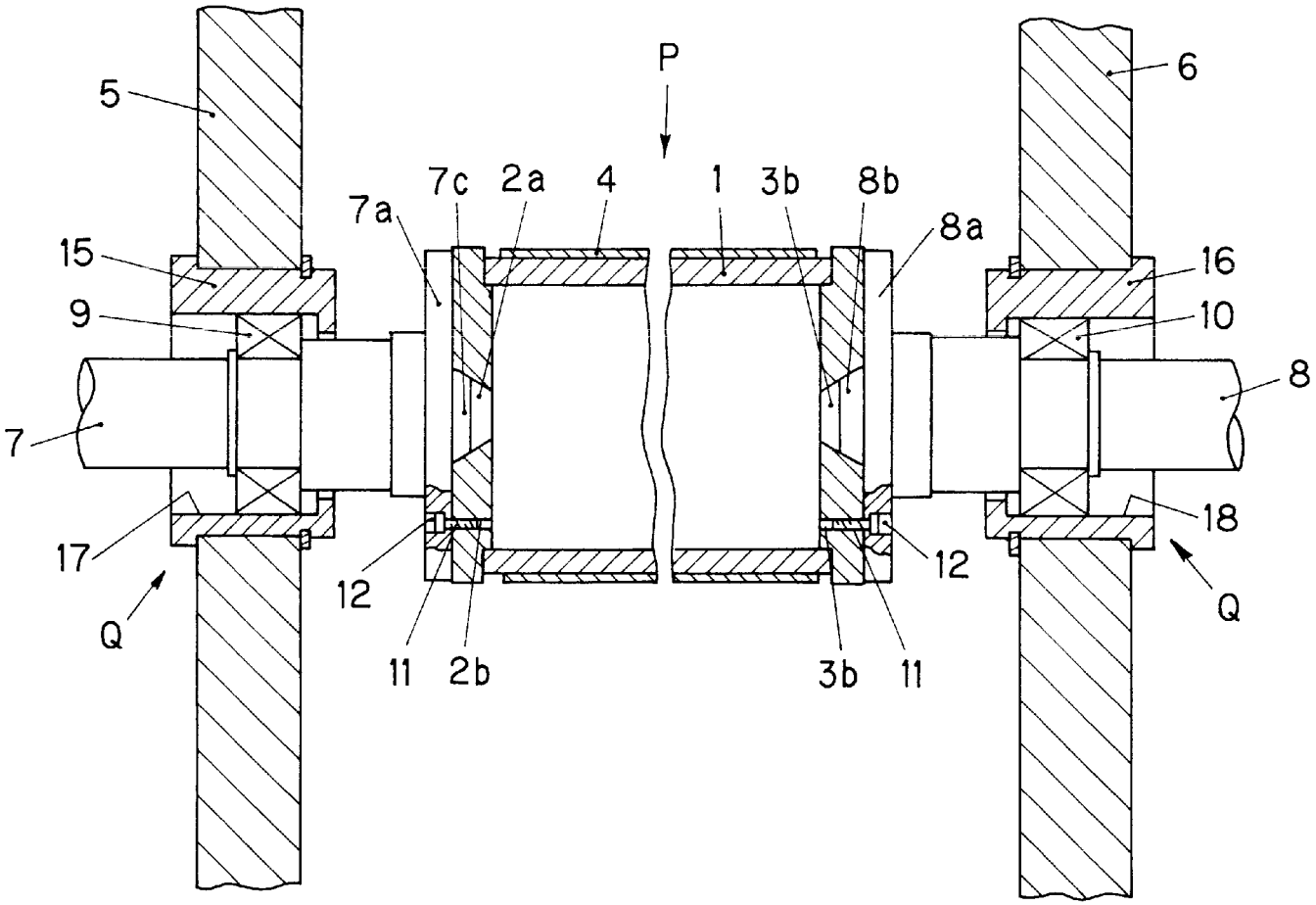
FIG. 2 is a partial cross section of an assembly including printing cylinder support means and the printing cylinder for offset printing according to the first embodiment of the present invention.

In the first embodiment shown in FIGS. 1 and 2, in order to enable positioning before connection to the support shaft 7 and 8, tapered circular depressions 2*a* and 3*a* are formed on the outer side surfaces of the bearers 2 and 3, respectively, such that the depressions 2*a* and 3*a* increase in diameter toward their open ends and such that the center axes of the depressions 2*a* and 3*a* are aligned with each other. Further, a plurality (three in the illustrated embodiment) of threaded holes 2*b* are formed in the bearer 2 at positions which are not symmetrical with respect to the center of the bearer 2, and similarly, a plurality (three in the illustrated embodiment) of threaded holes 3*b* are formed in the bearer 3 at positions which are not symmetrical with respect to the center of the bearer 3.

As shown in FIG. 2, flanges 7*a* and 8*a* are formed at the shaft ends of the support shafts 7 and 8, respectively, which shaft ends are located inside the frames 5 and 6, respectively. Truncated conical projections 7*b* and 8*b* are formed on the opposed surfaces of the flanges 7*a* and 8*a*, respectively, such that their center axes are aligned with each other. The truncated conical projections 7*b* and 8*b* have such a shape that the truncated conical projections 7*b* and 8*b* fit perfectly into the tapered circular depressions 2*a* and 3*a* formed on the side surfaces of the bearers 2 and 3. Upon engagement, the tapered circular depressions 2*a* and 3*a* and the truncated conical projections 7*b* and 8*b* each constitute an engagement portion which aligns the cylinder member P and the support members 7 and 8 along a common axis.

Axially extending bolt holes 12 are formed in the flange 7*a* (8*a*) of the support shaft 7 (8) at positions which coincide with the positions of the threaded hole 2*b* (3*b*) of the bearer 2 (3) upon the truncated conical projection 7*b* (8*b*) being fitted into the tapered circular depression 2*a* (3*a*) of the bearer 2 (3). Bolts 11 having been inserted into the bolt holes 12 are screwed into the threaded holes 2*b* (3*b*) in order to connect the support shaft 7 (8) to the cylinder member P.

Figure 3:
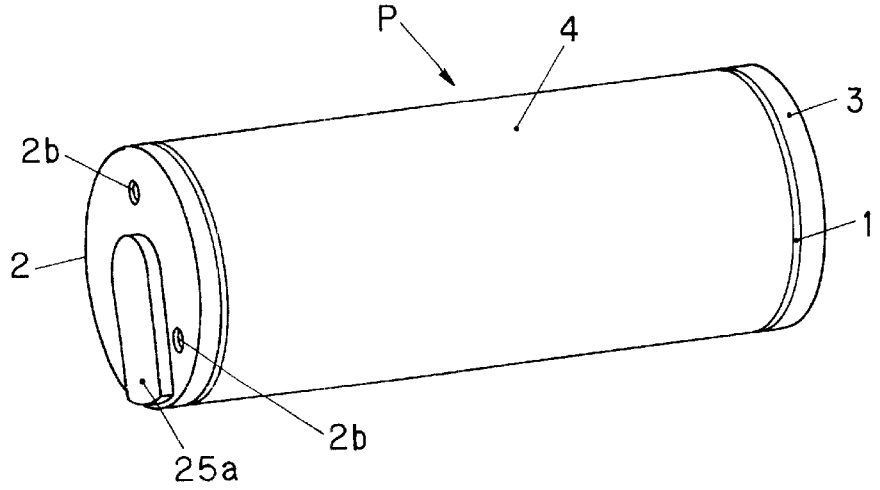
FIG. 3 is a perspective view of a printing cylinder for offset printing according to a second embodiment of the present invention.
Figure 5:
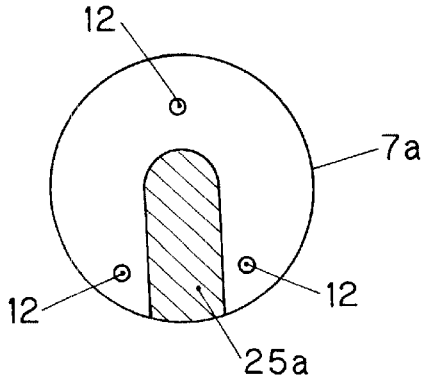
FIG. 5 is a cross section taken along line V—V in FIG. 4.
Figure 4:
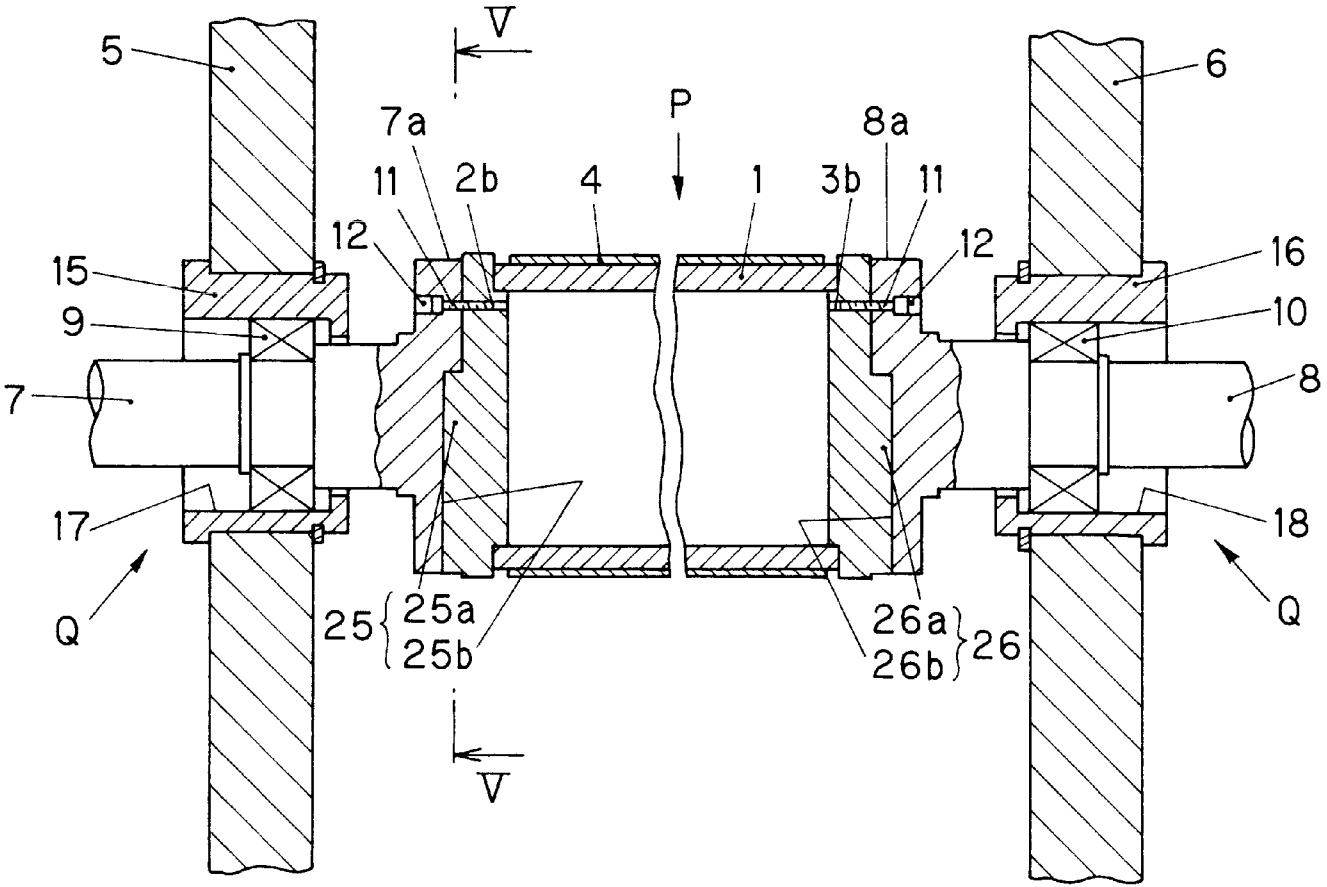
FIG. 4 is a partial cross section of an assembly including printing cylinder support means and the printing cylinder for offset printing according to the second embodiment of the present invention.

In the second embodiment shown in FIGS. 3, 4, and 5, in order to enable positioning before connection to the support shaft 7 and 8, ridge portions 25*a* and 26*a* are formed on the outer side surfaces of the bearers 2 and 3, respectively. As shown in FIG. 3, each of the ridge portions 25*a* and 26*a* extends in the radial direction of the respective bearer from the circumferential edge to the center, and has a substantially constant width and a predetermined thickness. Further, a plurality (three in the illustrated embodiment) of threaded holes 2*b* are axially formed in the bearer 2 at positions which are not symmetrical with respect to the center of the bearer 2, and similarly, a plurality (three in the illustrated embodiment) of threaded holes 3*b* are axially formed in the bearer 3 at positions which are not symmetrical with respect to the center of the bearer 3.

As shown in FIG. 4, flanges 7*a* and 8*a* are formed at the shaft ends of the support shaft 7 and 8, respectively, which shaft ends are located inside the frames 5 and 6, respectively. Grooves 25*b* and 26*b* are formed on the opposed surfaces of the flanges 7*a* and 8*b*. The grooves 25*b* and 26*b* have such a shape that the ridge portions 25*a* and 26*a* formed on the outer side surfaces of the bearers 2 and 3 fit perfectly into the grooves 25*b* and 26*b*. Upon engagement, the ridge portions 25*a* and 26*a* and the grooves 25*b* and 26*b* each constitute an engagement portion which aligns the cylinder member P and the support members 7 and 8 along a common axis.

Contrary to the illustrated example, the grooves 25*b* and 26*b* may be formed on the outer side surfaces of the bearers 2 and 3, and the ridge portions 25*a* and 26*a* may be formed on the opposed surfaces of the flanges 7*a* and 8*a* of the support shafts 7 and 8.

In either case, although not illustrated, the ridge portions 25*a* and 26*a* and the grooves 25*b* and 26*b* may have a shape such that at least width or thickness (depth) of the ridge portions 25*a* and 26*a* and the grooves 25*b* and 26*b* decreases from the outer circumferential edge toward the center potion.

This tapered shape facilitates the operation of fitting the ridge portions 25*a* and 26*b* into the grooves 25*b* and 26*b* performed when the cylinder member P is attached onto the printing machine, which will be described later.

Axially extending bolt holes 12 are formed in the flange 7*a* (8*a*) of the support shaft 7 (8) at positions which coincide with the positions of the threaded holes 2*b* (3*b*) of the bearer 2 (3) upon the ridge portion 25*a* (26*a*) of the bearer 2 (3) being fitted into the groove 25*b* (26*b*). Bolts 11 having been inserted into the bolt holes 12 are screwed into the threaded holes 2*b* (3*b*) in order to connect the support shaft 7 (8) to the cylinder member P.

In both the embodiments, the eccentric holes 17 and 18 are formed in the eccentric sleeves 15 and 16 in the printing cylinder support means such that the eccentric holes 17 and 18 are aligned with each other. As the eccentric sleeves 15 and 16 are rotated by use of appropriate means, the support shafts 7 and 8 attached to the eccentric sleeves 15 and 16 move such that their center axes move along a common arcuate path.

Through this operation, the printing cylinder is moved between a position at which the printing cylinder comes in pressure contact with an adjacent cylinder and a position at which the printing cylinder separates from the adjacent cylinder. When the support shafts 7 and 8 are connected to the cylinder member P, the eccentric sleeves 15 and 16 are rotated to the position at which the printing cylinder separates from the adjacent cylinder, whereby the connection operation can be performed without occurrence of interference with the adjacent cylinder.

Now, an operation of attaching the cylinder member P onto the printing machine will be described with reference to the drawings.

(1) First, the eccentric sleeves 15 and 16 are rotated to such an angular position that when the support shafts 7 and 8 of the printing cylinder support means Q are connected to the cylinder member P, the cylinder member P separates from the adjacent cylinder (not shown), to thereby facilitate the attachment of the cylinder member P.

Specifically, the eccentric sleeves 15 and 16 are rotated by use of appropriate means in order to move the support shafts 7 and 8—which are supported eccentrically on the eccentric sleeves 15 and 16 with respect to the rotational center of the eccentric sleeves 15 and 16—to a position for attachment of the cylinder member P, along an arcuate path centered on the rotational center of the eccentric sleeves 15 and 16.

(2) Subsequently, in the first embodiment shown in FIGS. 1 and 2, the support shafts 7 and 8 are axially moved by use of appropriate means in order to further separate the support shafts 7 and 8 to thereby secure a space for attachment of the cylinder member P between the support shafts 7 and 8 of the printing cylinder support means Q. In the second embodiment shown in FIGS. 3 and 4 in which positioning is performed by use of the engagement portions 25 and 26, the operation of further separating the support shafts 7 and 8 is not necessarily required.

(3) Subsequently, in the first embodiment, the cylinder member P is supported by use of, for example, an unillustrated manipulator, and the cylinder member is moved to the space between the support shafts 7 and 8. Subsequently, the support shafts 7 and 8—which have been positioned at a rotational phase such that the bolt holes 12 are aligned with the threaded holes 2*b* and 3*b* provided at the opposite ends of the cylinder member P—are advanced toward each other in order to fit the truncated conical projections 7*b* and 8*b* of the support shafts 7 and 8 into the tapered circular depressions 2*a* and 3*a*, respectively, of the bearers 2 and 3 of the cylinder member P.

In the second embodiment, the support shafts 7 and 8 are rotated for positioning such that the grooves 25*b* and 26*b* of the flanges 7*a* and 8*a* assume the same rotational phase; e.g., a rotational phase at which the open ends of the grooves 25*b* and 26*b* face upward. Meanwhile, the cylinder member P is supported by use of an unillustrated manipulator at such a rotational phase that the ridge portions 25*a* and 26*a* of the bearers 2 and 3 extend vertically. The cylinder member P supported in this manner is moved from above to the space between the support shafts 7 and 8, while the ridge portions 25*a* and 26*a* of the bearers 2 and 3 are fitted into the grooves 25*b* and 26*b* of the flanges 7*a* and 8*a* of the support shafts 7 and 8.

Alternatively, as in the case of the first embodiment, the support shafts 7 and 8 are axially moved by use of appropriate means in order to further separate the support shafts 7 and 8 to thereby secure a space for attachment of the cylinder member P between the support shafts 7 and 8 of the printing cylinder support means Q. Subsequently, the support shafts 7 and 8—which have been positioned at a rotational phase such that the grooves 25*b* and 26*b* of the flanges 7*a* and 8*a* have the same rotational phase as that of the ridge portions 25*a* and 26*a* of the bearers 2 and 3—are advanced toward each other in order to fit the ridge portions 25*a* and 26*a* of the bearers 2 and 3 of the cylinder member P into the grooves 25*b* and 26*b* of the flanges 7*a* and 8*a* of the support shafts 7 and 8.

(4) Subsequently, after the bolts 11 are inserted into the bolt holes 12 of the flanges 7*a* and 8*a* of the support shafts 7 and 8, the bolts 11 are tightened for temporary fastening by use of a tool, so that the cylinder member P is connected to the support shafts 7 and 8 with a predetermined phase relationship being established therebetween.

Subsequently, the bolts 11 which connect the cylinder member P to the support shafts 7 and 8 are further tightened in a uniform manner. As a result, in the first embodiment, the truncated conical projections 7*b* and 8*b* of the support shafts 7 and 8 are fitted more closely into the tapered circular depressions 2*a* and 3*a* of the cylinder member P.

The cylinder member P is attached to and supported by the support shafts 7 and 8 such that they share a common center axis. In the second embodiment, such attachment of the cylinder member P is established in a state in which the ridge portions 25*a* and 26*a* of the bearers 2 and 3 of the cylinder member P are fitted into the grooves 25*b* and 26*b* of the flanges 7*a* and 8*a* of the support shafts 7 and 8.

Thus, the cylinder member P is attached onto the printing machine.

Finally, the unillustrated manipulator is operated to separate from the cylinder member P to thereby complete the operation of attaching the printing cylinder onto the printing machine. When the cylinder member P is to be removed from the printing cylinder support means Q, the above-described procedures for attachment work are performed in reverse sequence.

The present invention is not limited to the above-described embodiments, and any design change is possible without departing from the scope of the appended claims.

What is claimed is:

1. A printing cylinder for offset printing comprising:

a cylinder member of a hollow cylinder having a covering portion which forms a substantially uniform, smooth outer circumferential surface having no spliced portion in the circumferential direction, the covering portion being capable of transferring printing images onto an adjacent printing cylinder or printing paper in contact with the covering portion; and printing cylinder support means including a pair of support shafts which are supported on opposed frames such that the support shafts are rotatable about a common axis, the support shafts each having a shaft end portion which is connected to an end portion of the cylinder member via an engagement portion and by use of connection means;

wherein the connection means includes a plurality of threaded members disposed to extend between a bearer provided at either end of the cylinder member and a flange provided at the shaft end portion of the corresponding support shaft such that the threaded members are located at a plurality of positions which are not symmetrical with respect to the centers of the bearer and the flange.

2. A printing cylinder for offset printing according to claim 1, wherein each engagement portion includes a tapered circular depression formed at the center of an end surface of the cylinder member and having a diameter which increases toward the open end of the depression, and a truncated conical projection formed at the center of the shaft end portion of the support shaft located at the inner side of the corresponding frame, wherein the truncated conical projection has a shape corresponding to that of the tapered circular depression.

3. A printing cylinder for offset printing according to claim 1, wherein each of the support shafts is disposed to penetrate the corresponding frame and is supported on the frame via an eccentric sleeve and a bearing, the eccentric sleeve being supported on the frame such that rotation of the eccentric sleeve is permitted but axial movement of the eccentric sleeve is restricted, and the bearing being accommodated within an eccentric through hole of the eccentric sleeve such that the bearing is movable in the axial direction.

4. A printing cylinder for offset printing comprising:

a cylinder member of a hollow cylinder having a covering portion which forms a substantially uniform, smooth outer circumferential surface having no spliced portion in the circumferential direction, the covering portion being capable of transferring printing images onto an adjacent printing cylinder or printing paper in contact with the covering portion; and printing cylinder support means including a pair of support shafts which are supported on opposed frames such that the support shafts are rotatable about a common axis, the support shafts each having a shaft end portion which is connected to an end portion of the cylinder member via an engagement portion and by use of connection means;

wherein each of the support shafts is disposed to penetrate the corresponding frame and is supported on the frame via an eccentric sleeve and a bearing, the eccentric sleeve being supported on the frame such that rotation of the eccentric sleeve is permitted but axial movement of the eccentric sleeve is restricted, and the bearing being accommodated within an eccentric through hole of the eccentric sleeve such that the bearing is movable in the axial direction.

5. A printing cylinder for offset printing according to claim 4, wherein each engagement portion includes a tapered circular depression formed at the center of an end surface of the cylinder member and having a diameter which increases toward the open end of the depression, and a truncated conical projection formed at the center of the shaft end portion of the support shaft located at the inner side of the corresponding frame, wherein the truncated conical projection has a shape corresponding to that of the tapered circular depression.

6. A printing cylinder for offset printing according to claim 5, wherein the connection means includes a plurality of threaded members disposed to extend between a bearer provided at either end of the cylinder member and a flange provided at the shaft end portion of the corresponding support shaft such that the threaded members are located at a plurality of positions which are not symmetrical with respect to the centers of the bearer and the flange.

* * * * *